US005154313A

United States Patent [19]

Lichac et al.

[11] Patent Number: 5,154,313

[45] Date of Patent: Oct. 13, 1992

[54] MODULAR TICKET STORAGE TRAY

[75] Inventors: Gerald J. Lichac, Santa Cruz; Wade Winblad, Hayward, both of Calif.

[73] Assignee: Atari Games Corporation, Milpitas, Calif.

[21] Appl. No.: 694,106

[22] Filed: May 1, 1991

[51] Int. Cl.[5] ..... A47K 10/24

[52] U.S. Cl. ..... 221/45; 312/321.5; 273/118 A

[58] Field of Search ..... 221/33, 45, 46, ; 226/196; 312/321.5, 129; 211/90, 88; 273/352, 143 R; 293/118 A

[56] References Cited

U.S. PATENT DOCUMENTS

| | | | |
|---|---|---|---|
| 2,505,898 | 5/1950 | Jaffe et al. | 312/321.5 |
| 2,926,915 | 3/1960 | Johns | 273/118 A |
| 3,940,136 | 2/1976 | Runte | 273/85 R |
| 4,094,416 | 6/1978 | Smith | 211/88 |
| 4,397,509 | 8/1983 | Millert et al. | 312/320 |
| 4,898,354 | 2/1990 | Whittington et al. | 211/88 |
| 4,984,693 | 1/1991 | Belokin, Jr. et al. | 211/90 |

*Primary Examiner*—Robert P. Olszewski
*Assistant Examiner*—Kenneth Noland
*Attorney, Agent, or Firm*—Knobbe, Martens, Olson & Bear

[57] ABSTRACT

The present invention provides a coupon dispensing storage tray for housing either a roll or pack of detachably connected coupons such as award tickets proximate to an electronic dispenser in a coupon dispensing housing. The tray can be secured to the back of a ticket accessing door adjacent a ticket dispenser. The tray comprises a first and second side wall, a closure wall secured to the side walls at a first end and a guide wall secured to the side walls proximate to a second end. A pack or roll of tickets is positionable between the side walls so that it rests on a support wall spanning the closure wall and the guide wall. The storage tray includes a curvilinear guide arm which assists in guiding the continuous pack of tickets out of the enclosure as the pack is pulled by the electronic dispenser. The guide arm is preferably constructed in unison with the guide wall. First and second securing legs extend outwardly from the second end of both side walls. The storage tray also includes an access window in the first side wall which facilitates the replacement of a pack of tickets. The access window spans the entire width of the first side wall and preferably includes a portion of the support wall upon which the ticket pack rests.

11 Claims, 1 Drawing Sheet

MODULAR TICKET STORAGE TRAY

FIELD OF THE INVENTION

The present invention relates generally to systems for dispensing tickets and more particularly to storage trays for the storage of dispensable ticket packs in ticket dispensing systems.

BACKGROUND OF THE INVENTION

It can be said that coupons or tickets present an easily transferable and disposable means for permitting one to utilize many modern day conveniences. For instance, tickets are used as a means of accessing various modes of transportation, e.g., buses and railways. It is not uncommon to find ticket dispensing machines being utilized at bus depots and train stations on which passengers desiring to ride a bus or train rely. In addition, other places which commonly dispense tickets include theaters and amusement parks. Even in some cases, vending machines employ a ticket dispensing system as a means for permitting a user to purchase various items. As a result, ticket dispensing systems are found in many aspects of society.

Other instances of coupon use can be found in arcade game halls. With many arcade games, accumulating higher scores is not merely manifested in the registering of a score total which is displayed on a game display, but also in the dispensing of coupons in the form of award tickets which may be exchanged for prizes. Specialty games, such as video games and bowling games, award varying levels of playing success to a player by dispensing a specified amount of award tickets. As a result, the endurance of a player in an arcade game hall is not only reflected in the pride of achieving higher scores but in the accumulation of greater amounts of award tickets. These award tickets may then be accumulated and exchanged for prizes or additional game playing time.

Conventional award tickets, as with most types of dispensable tickets, are dispensed in the form of individual tickets connected in series and stored within cabinets housing the arcade games. Such tickets are commonly available in rolls or packs of sufficient size to preclude frequent replacement. A typical pack includes a series of tickets, usually numbering in the thousands, each separated by a line of perforations for facilitating separation by the game player.

When installing a pack or roll of award tickets, a user must typically feed the lead end of the tickets through a dispenser located in the interior of the ticket cabinet. The dispenser automatically directs the lead end of the pack through to the exterior of the ticket cabinet for receipt by a player. With award tickets, the pack is continuously fed in increments of one or more tickets corresponding to score achievement until the pack is depleted. When the pack is depleted, the dispenser is replenished with a new pack and the process continues. There are presently a number of systems for dispensing tickets, such as that disclosed in U.S. Pat. No. 2,926,915 to Johns. There, a skee ball machine is disclosed which includes an electronic dispenser integrated in a circuit that responds to the progress of the game as controlled by a user. When the player has attained a certain predetermined score, the electronic dispenser is actuated to begin dispensing tickets in increments corresponding to increasing score.

Other contemporary dispensers are similarly electrically actuated and are integrated with the progress of the game being played. Ticket dispensers are usually not observable to players as they are generally mounted to the back of an access door located on the front of the arcade game cabinet. The access door includes a slot aligned with the output of a ticket dispenser to permit the passage of tickets therethrough. As the tickets are dispensed commensurate with the progress of play, the tickets may be separated from the dispenser by the player and collected for later use.

Despite the seemingly easy manner in which tickets are intended to be dispensed, as a practical matter, the continuous feeding of a ticket roll or pack into an electronic dispenser is often sloppy at best. Typically, a pack of tickets is placed in a holder on the floor of the an arcade game cabinet. Because the ticket dispenser itself is preferably located at about waist level to players, there is often a large separation between the pack of tickets in the holder on the floor and the dispenser. As indicated above, the lead end of the ticket pack is fed into the receiver of the electronic dispenser. As the tickets are dispensed, the lead end of the ticket pack is pulled by the force of the actuated dispenser in an unguided fashion from the floor.

There are inherent problems with this arrangement which sometimes results in the inaccurate feeding of tickets. Due to this cumbersome arrangement, the lead end is not always guided cleanly into the dispenser. As often happens, the direct feeding of the tickets from the floor of the game cabinet causes the tickets to be lodged in the receiver of the dispenser because the tickets enter at an improper angle. In addition, when the dispenser door is opened, thereby pulling the dispenser out simultaneously, a certain portion of the tickets are pulled from the holder on the floor. When the access door is re-closed, the portion of the deployed tickets not dispensed through the dispenser causes slack in the contiguous line of tickets. This slack can also result in the tickets being misfed into the ticket dispenser, as well as possibly getting caught in the access door upon closure. The lodging of tickets results in a restriction to the free deployment of the ticket pack as desired and often results in the tickets being torn apart at the perforations due to the pulling force of the dispenser against the restricted ticket pack. This unfortunate scenario necessarily entails the temporary shutdown of the game, possibly requiring maintenance service.

In addition to inaccurate feeding problems, the fact that the pack is placed on the floor of the cabinet complicates access to the ticket pack in periods of servicing. A person reloading a dispenser or servicing a malfunctioning dispenser must place their hand deeply into the arcade cabinet in order to replace a new pack of tickets or retrieve a misfed pack. This is a cumbersome task at best.

There is therefore a need to provide a means for conveniently storing a pack of detachably connected coupons such as tickets in a location proximate to a ticket dispenser that is easily accessible. In addition, it would be novel development to incorporate within the storing means a guiding means which would significantly reduce the risk of misfeeding tickets to the dispenser.

SUMMARY OF THE INVENTION

The present invention provides a coupon dispensing storage tray for housing either a roll or pack of detachably connected coupons such as tickets proximate to an electronic dispenser in a coupon dispensing housing. With the present invention, the pack of coupons or tickets may be stored in the storage tray in a manner which facilitates its dispensing through an electronic dispenser associated with the storage tray and which facilitates maintenance service associated with the dispenser.

One of the more valuable features of the present invention is that it can be secured to the back of a ticket accessing door adjacent a ticket dispenser. In this manner, the storage tray improves upon the feeding of tickets into a ticket dispenser without the problems associated with opening and closing the access door while the tickets are fed into the dispenser. Furthermore, by configuring the storage tray so as to be mountable to the rear side of an access door, the pack of tickets are more easily available to the operator for changing the tickets since the storage tray rotates outwardly with the access door.

The preferred embodiment of the storage tray comprises a five-sided enclosure which is configured to dispensably secure a pack of award tickets therein. The enclosure comprises a first and second side wall, a closure wall secured to the side walls at a first end and a guide wall secured to the side walls proximate to a second end. The pack of tickets is positionable between the side walls so that it rests on a support wall spanning the closure wall and the guide wall. The storage tray includes a curvilinear guide arm which assists in guiding the continuous pack of tickets out of the enclosure as the pack is pulled by the electronic dispenser. The guide arm is preferably constructed in unison with the guide wall.

Extending outwardly from the second end of both side walls are first and second securing legs which permit a user to secure the storage tray to a vertical wall of an arcade game cabinet such as the interior side of an access door. The securing legs are preferably configured in the form of L-shaped brackets constructed integral with the side walls.

When the storage tray is secured in operating position within the arcade game cabinet, a pack of tickets may be placed therein. The ticket pack rests on the support wall and is confined in a dispensable fashion between the two side walls. In addition, the storage tray is preferably positioned so that the free end of the guide arm is in substantial alignment with the receiver of the adjacent ticket dispenser preferably located immediately above the storage tray. Depending on the size of the electronic dispenser, the guide arm can be fashioned in varying lengths to accommodate the alignment of the guide arm with the receiver of the dispenser.

In the preferred embodiment, the storage tray also includes an access window in the first side wall. The access window facilitates the replacement of a pack of tickets by exposing a larger area of the ticket pack to the user as it is inserted within the storage tray. The access window spans the entire width of the first side wall and preferably includes a portion of the support wall upon which the ticket pack rests. This latter portion of the access window permits a user to grasp the pack of tickets from two sides, thus facilitating the removal and installation of ticket packs from within the storage tray.

With the present invention, a means for conveniently storing a roll or pack of award tickets proximate to a ticket dispenser is provided. The present invention contemplates a dispensing system which includes a coupon dispensing housing such as a game cabinet having an access door wherein both the present storage tray and a dispenser are mounted adjacently on an interior side of the access door. With this arrangement, the present invention advantageously minimizes the risk of misfeeding tickets into the dispenser and permits easy replacement of ticket packs. Other advantages will be appreciated from the description of the present invention in association with the figures as described below.

DETAILED DESCRIPTION OF THE INVENTION

Reference is now made to the figures wherein like parts are designated with like numerals throughout.

Figure 1:
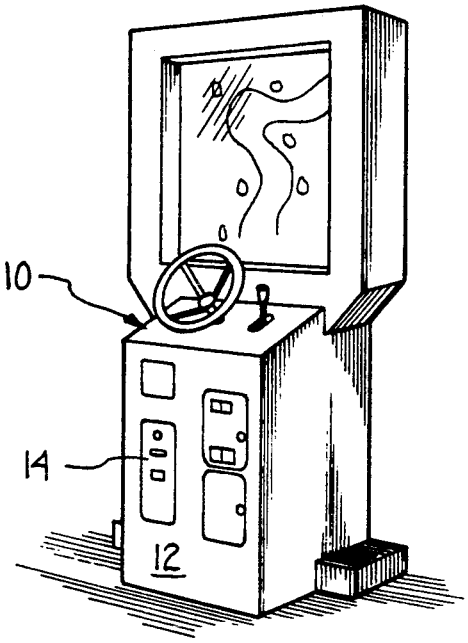
FIG. 1 is a perspective schematic view of an arcade game cabinet illustrating the location of an access door to which the present invention is secured.

The present invention provides a means for conveniently storing a pack or roll of continuously-attached coupons proximate to a coupon dispenser within a coupon-dispensing cabinet. An anticipated use for the present invention is with arcade games which dispense coupons in the form of award tickets as a method of rewarding successful levels of play. Typically, arcade game cabinets are arranged so that coin or token receptacles and ticket dispensers are positioned behind and secured to a locked access door. Referring to FIG. 1, an arcade game cabinet 10 is schematically shown having a front face 12 wherein the front face 12 includes an access door 14. The present invention is configured to be secured to the rear of access door 14 on the arcade game cabinet 10 as will be described below. It should be appreciated from FIG. 1 that the storage tray of the present invention is normally not visible to view by arcade game users unless the access door 14 is opened for servicing purposes.

Figure 2:
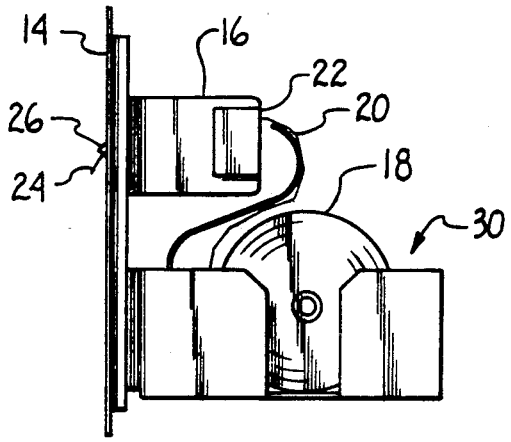
FIG. 2 is a side view of the preferred embodiment of the present invention shown mounted to the rear side of the access door of FIG. 1 and below a ticket dispenser similarly secured to the access door.

Referring now to FIG. 2, operation of the present invention in association with an electronic dispenser can be described. There, a side view of the access door 14 is shown wherein a ticket dispenser 16 is secured to the interior side of the access door 14. A pack of award tickets 18 is shown being fed into the ticket dispenser 16. A lead portion 20 of the ticket pack 18 is fed into a receiver 22 of the ticket dispenser 16 for the controlled passage of the ticket pack 18 therethrough. A lead end 24 of the lead portion 20 is shown extending out of an output slot 26 visible to an arcade game user. The output slot 26 is provided in the access door 14 and is in alignment with an output portion (not shown) of the ticket dispenser 16. A player of the arcade game 10 (shown in FIG. 1) may tear away the exposed lead end 24 of the ticket pack 18 as the tickets are advanced through the ticket dispenser 16 commensurate with play success.

Still referring to FIG. 2, it can be seen that the present invention comprises a storage tray 30 which conveniently houses the ticket pack 18 proximate to the ticket dispenser 16. The storage tray 30 is preferably mounted to the back of the access door 14 in a manner which permits the lead portion 20 of the ticket pack 18 to be fed directly into the ticket dispenser 16. It should be appreciated from FIG. 2 that the ticket pack 18 is housed within the storage tray 30 in a manner which permits the ticket pack 18 to be dispensed from within the storage tray 30 as the lead portion 20 is pulled through the ticket dispenser 16.

Figure 3:
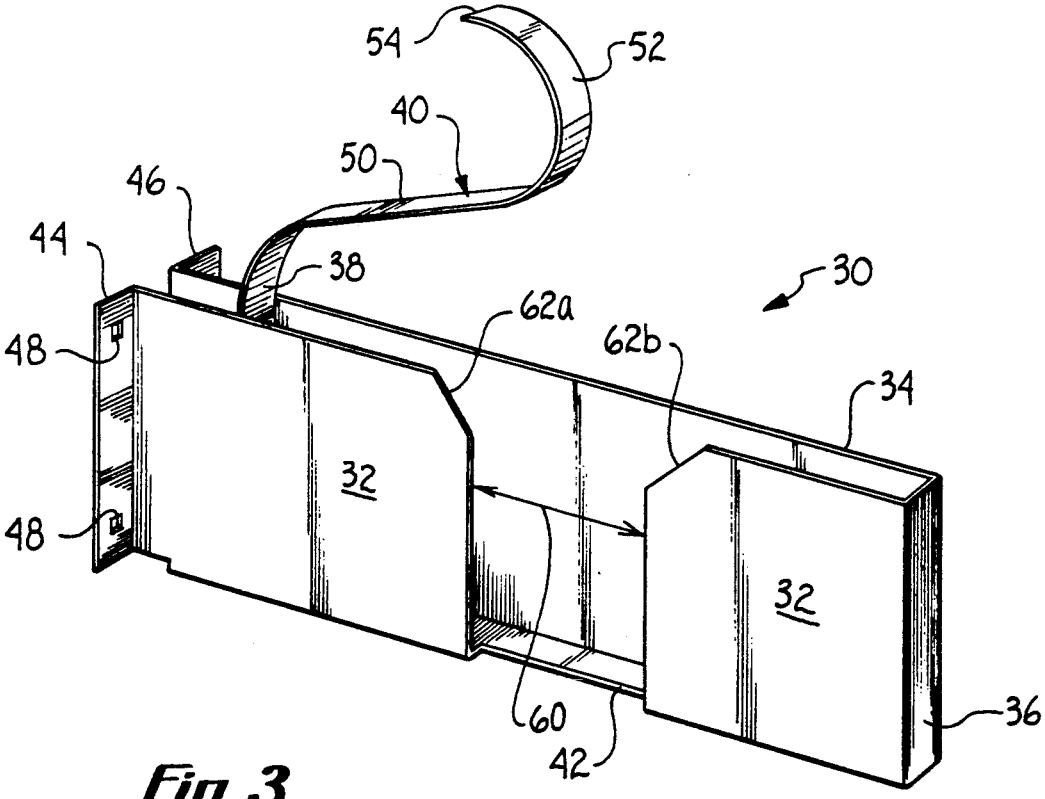
FIG. 3 is a perspective view of the present invention of FIG. 2 shown in its preferably operating orientation.

Referring now to FIG. 3, the preferred embodiment of the storage tray 30 can be described in more detail. In the preferred embodiment, the storage tray 30 comprises a fivesided enclosure having first and second side walls 32 and 34, respectively. Spanning a first end of the side walls 32 and 34 is a closure wall 36. In addition, a guide wall 38 spans the first and second side walls 32 and 34 proximate to a second end of the side walls and extends upwardly from, and integral with, a guide arm 40. Finally, a support wall 42 is secured to a lower end of the side walls 32 and 34 and functions to support the ticket pack 18 (FIG. 2) within the tray 30. In the preferred embodiment, the Various walls of the storage tray 30 are rigidly secured together. With this arrangement, a pack of tickets can be securably stored within the storage tray 30 and confined between the side walls 32 and 34, the closure wall 36, the guide wall 38 and the support wall 42.

Still referring to FIG. 3, it can be seen that securing legs 44 and 46 extend outwardly from the second end of the side walls 32 and 34 wherein the securing legs 44, 46 permit a user to secure the storage tray 30 to a wall. In the preferred embodiment, the securing legs 44, 46 each comprise an L-shaped bracket constructed integrally with the side walls 32 and 34. The securing legs 44, 46 include a plurality of bolt holes 48 which accommodate mechanical fasteners (not shown), such as bolts, and which assist in securing the storage tray to a wall.

The guide arm 40 preferably has a curvilinear configuration comprising a substantially straight portion 50 and an arcuate portion 52. It is intended that the guide arm 40 be configured so that, upon the installation of the storage tray 30, an end 54 of the guide arm 40 is in substantial alignment with the receiver of the ticket dispenser 16 (FIG. 2). With such an arrangement, a ticket pack 18 housed within the storage tray 30 can be fed smoothly and directly to the ticket dispenser 16 in a manner shown in FIG. 2.

In FIG. 3, it can be seen that the preferred embodiment of the storage tray 30 includes an access window 60 extending across the first side wall 32 and including an area removed from the support wall 42. First and second access window corners **62*a* and 62*b* are preferably bevelled to eliminate sharp edges which may cause injury to maintenance personnel in servicing the storage tray 30. The access window 60 is configured so that service personnel may grasp a ticket pack (not shown) from opposite sides, i.e., from the top and bottom of the ticket pack. This facilitates the installation and removal of ticket packs from the storage tray 30**. It should be noted that coupons stored in the form of a roll or any other similar fashion may be effectively stored and dispensed with the present invention. As a result, the present invention is not to be limited only to the storing and dispensing of a pack of award tickets.

The invention may be embodied in other specific forms without departing from its spirit or essential characteristics. The described embodiment is to be considered in all respects only as illustrative and not restrictive and the scope of the invention is, therefore, indicated by the appended claims rather than by the foregoing description. All changes which come within the meaning and range of equivalency of the claims are to be embraced within their scope.

What is claimed:

1. A storage tray for the storage of detachable coupons, said storage tray comprising:

an enclosure having first and second side walls, a support wall, and a closure wall spanning first edges of the first and second side walls;

an access window in the first side wall extending across said first side wall;

a guide wall spanning the first and second side walls and extending substantially upwardly to a desired point above the enclosure;

a cantilevered guide arm integral with the guide wall, said guide arm having a curvilinear configuration, and an enclosure support comprising first and second legs extending from the side walls, each of said legs having an outwardly directed flange for fastening the enclosure to a substantially vertical wall.

2. A storage tray comprising:

a rigid enclosure having a support wall, first and second side walls and a closure wall;

an access window included in the first side wall;

means located at a first end of the enclosure for supporting the enclosure;

a guide wall spanning the two side walls and extending upwardly from the support wall, and a guide arm integral with the guide wall and extending upwardly therefrom.

3. The storage tray of claim 2 wherein the enclosure support means comprises first and second brackets each integral with the first and second side walls, respectively.

4. The storage tray of claim 2 wherein the guide arm has a curvilinear configuration.

5. A device for storing detachably-connected coupons comprising:

means for enclosing the coupons so as to be dispensably confined therewithin;

means for supporting the enclosing means on a substantially vertical wall;

means positioned on the enclosing means for facilitating the loading and unloading of the coupons; and means integral with the enclosing means for guiding the coupons away from the enclosing means.

6. The storage device of claim 5 wherein the enclosing means comprises first and second side walls, a support wall, and a closure wall spanning first edges of the first and second side walls.

7. The storage device of claim 6 wherein the supporting means comprises first and second brackets each integral with the first and second side walls, respectively.

8. The storage device of claim 5 wherein the facilitating means comprises an access window extending across a portion of the enclosing means.

9. The storage device of claim 5 wherein the guiding means comprises a guide arm integrally constructed with the enclosing means.

10. The storage device of claim 9 where the guiding arm has a curvilinear configuration.

11. A coupon dispensing system comprising:

a dispenser housing having an access door;

a coupon dispenser mounted to an interior side of the access door; and a coupon storage tray for storing a pack of detachably connected coupons, the storage tray being mounted on the interior side of the access door proximate to the coupon dispenser so as to permit coupons stored within said storage tray to be fed into said coupon dispenser, said storage tray comprising an enclosure having first and second side walls, a support wall, a closure wall spanning first edges of the first and second side walls, an access window in the first side wall, a guide wall spanning the first and second side walls, and a cantilevered guide arm integral with the guide wall.

* * * * *